US006416159B1

(12) United States Patent
Floyd et al.

(10) Patent No.: US 6,416,159 B1
(45) Date of Patent: Jul. 9, 2002

(54) BALLISTIC AEROSOL MARKING APPARATUS WITH NON-WETTING COATING

(75) Inventors: Philip D. Floyd, Sunnyvale; Frederick J. Endicott, San Carlos; Gregory B. Anderson, Woodside; Jurgen Daniel, Mountain View; Eric Peeters, Fremont, all of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/410,371

(22) Filed: Oct. 5, 1999

Related U.S. Application Data

(63) Continuation-in-part of application No. 09/163,893, filed on Sep. 30, 1998.

(51) Int. Cl.[7] ..... B41J 2/015

(52) U.S. Cl. ..... 347/21; 347/20

(58) Field of Search ..... 347/20, 21, 43, 347/45, 46, 65, 67; 346/140.1; 604/430; 355/10

(56) References Cited

U.S. PATENT DOCUMENTS

| | | | | |
|---|---|---|---|---|
| 2,504,482 A | * | 4/1950 | Goldman | 604/403 |
| 2,573,143 A | | 10/1951 | Jacob | 178/5.2 |
| 2,577,894 A | | 12/1951 | Jacob | 346/75 |
| 3,152,858 A | | 10/1964 | Wadey | 346/75 |
| 3,572,591 A | | 3/1971 | Brown | 239/337 |
| 3,977,323 A | | 8/1976 | Pressman et al. | 101/426 |
| 3,997,113 A | | 12/1976 | Pennebaker, Jr. | 239/15 |
| 4,019,188 A | | 4/1977 | Hochberg et al. | 346/75 |
| 4,106,032 A | | 8/1978 | Miura et al. | 347/21 |
| 4,113,598 A | | 9/1978 | Jozwiak, Jr. et al. | 204/181 R |
| 4,146,900 A | | 3/1979 | Arnold | 347/21 |

(List continued on next page.)

FOREIGN PATENT DOCUMENTS

| | | |
|---|---|---|
| EP | 0 655 337 A2 | 5/1995 |
| EP | 0 726 158 A1 | 8/1996 |
| JP | 35305539A(Abstract) | 4/1978 |
| JP | 53035539 A (abstract | 4/1978 |
| JP | 55 019556(Abstract) | 2/1980 |
| JP | 55 028819(Abstract) | 2/1980 |
| JP | 56 146773(Abstract) | 11/1981 |
| JP | 57-192027 A(abstract | 11/1982 |
| JP | 58-224760 | 12/1983 |
| JP | 60 229764 | 11/1985 |
| JP | 362035847A(Abstract) | 2/1987 |
| JP | 02 293151(abstract) | 12/1990 |
| JP | 4-158044 | 6/1992 |
| JP | 4-182138 | 6/1992 |
| JP | 5-4348 | 1/1993 |
| JP | 5-193140 | 8/1993 |
| JP | 5-269995 | 10/1993 |
| WO | WO 93/11866 | 6/1993 |
| WO | WO 94/18011 | 8/1994 |
| WO | WO 97/01449 | 1/1997 |
| WO | WO 97/27058 | 7/1997 |

OTHER PUBLICATIONS

US 5,828,388, 10/1998, Cleary et al. (withdrawn)

F. Anger, Jr. et al. Low Surface Energy Fluoro–Epoxy Coating for Drop–On–Demand Nozzles, IBM Technical Disclosure Bulletin, vol. 26, No. 1, p. 431, Jun. 1983.

(List continued on next page.)

*Primary Examiner*—Anh T. N. Vo

(57) ABSTRACT

In a ballistic aerosol marking device or the like, marking material flows from a material reservoir to a delivery channel via a port. The walls of the channel and or the port may be provided with a non-wetting coating to allow for control of the position of a meniscus formed in or at the port. By controlling the meniscus location, attributes of the system, such as the quantity of marking material delivered to the channel, the size of the marking material droplets delivered to the channel, the amount of foreign material (e.g., carrier liquid) delivered to the channel with the marking material, the field strength of gating electrodes, etc. may be controlled.

18 Claims, 12 Drawing Sheets

U.S. PATENT DOCUMENTS 4,171,777 A 10/1979 Behr ..... 239/422
4,189,937 A 2/1980 Nelson ..... 73/28
4,196,437 A 4/1980 Hertz ..... 346/1.1
4,223,324 A 9/1980 Yamamori et al. ..... 347/21
4,265,990 A 5/1981 Stolka et al. ..... 430/59
4,271,100 A 6/1981 Trassy ..... 261/78 A
4,284,418 A 8/1981 Andres ..... 55/16
4,368,850 A 1/1983 Szekely ..... 239/333
4,403,228 A 9/1983 Miura et al. ..... 346/75
4,403,234 A 9/1983 Miura et al. ..... 346/140 R
4,480,259 A 10/1984 Kruger et al. ..... 347/63
4,490,728 A 12/1984 Vaught et al. ..... 347/60
4,500,895 A 2/1985 Buck et al. ..... 347/87
4,514,742 A 4/1985 Suga et al. ..... 347/85
4,515,105 A 5/1985 Danta et al. ..... 118/629
4,523,202 A 6/1985 Gamblin ..... 346/75
4,538,899 A * 9/1985 Landa et al. ..... 355/10
4,544,617 A 10/1985 Mort et al. ..... 430/58
4,606,501 A 8/1986 Bate et al. ..... 239/346
4,607,267 A 8/1986 Yamamuro ..... 347/51
4,613,875 A 9/1986 Le et al. ..... 347/21
4,614,953 A 9/1986 Lapeyre ..... 347/43
4,634,647 A 1/1987 Jansen et al. ..... 430/84
4,647,179 A 3/1987 Schmidlin ..... 355/3 DD
4,663,258 A 5/1987 Pai et al. ..... 430/57
4,666,806 A 5/1987 Pai et al. ..... 430/57
4,683,481 A 7/1987 Johnson ..... 347/65
4,720,444 A 1/1988 Chen ..... 430/58
4,728,969 A 3/1988 Le et al. ..... 347/21
4,741,930 A 5/1988 Howard et al. ..... 427/265
4,760,005 A 7/1988 Pai ..... 430/65
4,770,963 A 9/1988 Pai et al. ..... 430/64
4,791,046 A 12/1988 Ogura ..... 430/296
4,839,232 A 6/1989 Morita et al. ..... 428/473.5
4,839,666 A 6/1989 Jayne ..... 346/75
4,870,430 A 9/1989 Daggett et al. ..... 347/88
4,882,245 A 11/1989 Gelorme et al. ..... 430/14
4,896,174 A 1/1990 Stearns ..... 346/459
4,929,968 A 5/1990 Ishikawa ..... 347/21
4,961,966 A 10/1990 Stevens et al. ..... 427/299
4,973,379 A 11/1990 Brock et al. ..... 156/640
4,982,200 A 1/1991 Ramsay ..... 346/75
5,030,536 A 7/1991 Pai et al. ..... 430/127
5,041,849 A 8/1991 Quate et al. ..... 347/46
5,045,870 A 9/1991 Lamey et al. ..... 347/59
5,063,655 A 11/1991 Lamey et al. ..... 29/611
5,066,512 A 11/1991 Goldowsky et al. ..... 427/14.1
5,113,198 A 5/1992 Nishikawa et al. ..... 347/21
5,190,817 A 3/1993 Terrell et al. ..... 428/343
5,202,704 A 4/1993 Iwao ..... 347/55
5,208,630 A 5/1993 Goodbrand et al. ..... 355/201
5,209,998 A 5/1993 Kavassalis et al. ..... 430/106
5,240,153 A 8/1993 Tubaki et al. ..... 222/385
5,240,842 A 8/1993 Mets ..... 435/172.3
5,294,946 A 3/1994 Gandy et al. ..... 347/3
5,300,339 A 4/1994 Hays et al. ..... 428/36.9
5,350,616 A 9/1994 Pan et al. ..... 428/131
5,363,131 A 11/1994 Momose et al. ..... 347/46
5,385,803 A 1/1995 Duff et al. ..... 430/138
5,397,664 A 3/1995 Noelscher et al. ..... 430/5
5,403,617 A 4/1995 Haaland ..... 427/180
5,425,802 A 6/1995 Burton et al. ..... 95/32
5,426,458 A 6/1995 Wenzel et al. ..... 347/45
5,428,381 A 6/1995 Hadimioglu et al. ..... 347/46
5,482,587 A 1/1996 McAleavey ..... 156/243
5,491,047 A 2/1996 Kim et al. ..... 430/329
5,510,817 A 4/1996 Sohn ..... 347/21
5,512,712 A 4/1996 Iwata et al. ..... 174/258
5,520,715 A 5/1996 Oeftering ..... 75/335
5,522,555 A 6/1996 Poole ..... 241/33
5,535,494 A 7/1996 Plesinger et al. ..... 29/25.35
5,541,625 A 7/1996 Holstun et al. ..... 347/5
5,554,480 A 9/1996 Patel et al. ..... 430/137
5,600,351 A 2/1997 Holstun et al. ..... 347/40
5,604,519 A 2/1997 Keefe et al. ..... 347/13
5,635,969 A 6/1997 Allen ..... 347/96
5,640,187 A 6/1997 Kashiwazaki et al. ..... 347/101
5,646,656 A 7/1997 Leonhardt et al. ..... 347/43
5,654,744 A 8/1997 Nicoloff, Jr. et al. ..... 347/43
5,678,133 A 10/1997 Siegel ..... 399/67
5,682,190 A 10/1997 Hirosawa et al. ..... 347/94
5,712,669 A 1/1998 Swanson et al. ..... 347/49
5,717,986 A 2/1998 Vo et al. ..... 399/291
5,731,048 A 3/1998 Ashe et al. ..... 427/585
5,756,190 A 5/1998 Hosomi et al. ..... 428/209
5,761,783 A 6/1998 Osawa et al. ..... 29/25.35
5,777,636 A 7/1998 Naganuma et al. ..... 347/10
5,780,187 A 7/1998 Pierrat ..... 430/5
5,787,558 A 8/1998 Murphy ..... 29/25.35
5,818,477 A 10/1998 Fullmer et al. ..... 347/43
5,853,906 A 12/1998 Hsieh ..... 428/690
5,882,830 A 3/1999 Visser et al. ..... 430/59
5,893,015 A 4/1999 Mojarradi et al. ..... 399/291
5,900,868 A 5/1999 Shimizu et al. ..... 347/93
5,958,122 A 9/1999 Fukuda et al. ..... 106/31.57
5,967,044 A 10/1999 Marschke ..... 101/363
5,968,674 A 10/1999 Hsieh et al. ..... 428/690
5,969,733 A 10/1999 Sheinman ..... 347/75
5,981,043 A 11/1999 Murakami et al. ..... 428/209
5,982,404 A 11/1999 Iga et al. ..... 347/173
5,990,197 A 11/1999 Escano et al. ..... 523/160
5,992,978 A 11/1999 Fujii et al. ..... 347/54
6,019,466 A 2/2000 Hermanson ..... 347/104
6,036,295 A 3/2000 Ando et al. ..... 347/7
6,081,281 A 6/2000 Cleary et al. ..... 347/21
6,116,718 A 9/2000 Peeters et al. ..... 347/21
6,154,226 A * 11/2000 York et al. ..... 346/140.1

OTHER PUBLICATIONS

N. A. Fuchs. The Mechanics of Aerosols, Dover Publications, Inc., p. 79, 367–377, 1989 (Originally published in 1964 by Pergamon Press Ltd.).

Hue Le et al. Air–Assisted Ink Jet with Mesa–Shaped Ink–Drop–Forming Orifice, Presented at the Fairmont Hotel in Chicago and San Jose, Fall 1987, p. 223–227.

No author listed, Array Printers Demonstrates First Color Printer Engine, The Hard Copy Observer Published by Lyra Research, Inc., vol. VIII, No. 4, p. 36, Apr. 1998.

U.S. application No. 09/041,353, Coated Photographic Papers, Filed Mar. 12, 1998.

U.S. application No. 09/407,908, Ballistic Aerosol Marking Apparatus with Stacked Electrode Structure, Filed Sep. 29, 1999.

U.S. application No. 09/164,124 (Attorney Docket D/98314Q1) entitled "Method of Marking a Substrate Employing a Ballistic Aerosol Marking Apparatus" to Eric Peeters et al., filed Sep. 30, 1998.

U.S. application No. 09/163,839 (Attorney Docket D/98409) entitled "Marking Material Transport" to Tuan Anh Vo et al., filed Sep. 30, 1998.

U.S. application No. 09/163,954 (Attorney Docket D/98562) entitled Ballistic Aerosol Marking Apparatus for Marking with a Liquid Material to Eric Peeters et al., filed Sep. 30, 1998.

U.S. application No. 09/163,924 (Attorney Docket D/98562Q1) entitled "Method for Marking with a Liquid Material Using a Ballistic Aerosol Marking Apparatus" to Eric Peeters et al., filed Sep. 30, 1998.

U.S. application No. 09/163,799 (Attorney Docket D/98565Q1) entitled "Method of Making a Print Head for Use in Ballistic Aerosol Marking Apparatus" to Eric Peeters et al., filed Sep. 30, 1998.

U.S. application No. 09/163,664 (Attorney Docket No. D/98566) entitled "Organic Overcoat for Electrode Grid" to Kaiser H. Wong et al., filed Sep. 30, 1998.

U.S. application No. 09/163,518 (Attorney Docket No. D/98577) entitled "Inorganic Overcoat for Particulate Transport Electrode Grid" to Kaiser H. Wong et al., filed Sep. 30, 1998.

U.S. application No. 09/164,104 (Attorney Docket D/98564) "Kinetic Fusing of a Marking Material" to Jaan Noolandi et al., filed Sep. 30, 1998.

U.S. application No. 09/163,825 (Attorney Docket D/98563) entitled "Multi–Layer Organic Overcoat for Electrode Grid" to Kaiser H. Wong, filed Sep. 30, 1998.

U.S. application No. 09/164,250 (Attorney Docket D/98314Q2) entitled "Ballistic Aerosol Marking Apparatus for Treating a Substrate" to.Eric Peeters et al., filed Sep. 30, 1998.

U.S. application No. 09/163,808 (Attorney Docket D/98314Q3) entitled "Method of Treating a Substrate Employing a Ballistic Aerosol Marking Apparatus" to Eric Peeters et al, filed Sep. 30, 1998.

U.S. application No. 09/163,765 (Attorney Docket D/98314Q4) entitled "Cartridge for Use in a Ballistic Aerosol Marking Apparatus" to Eric Peeters et al., filed Sep. 30, 1998.

U.S. application No. 09/163,839 (Attorney Docket D/98314) entitled "Ballistic Aerosol Marking Apparatus for Marking a Substrate" to Tuan Anh Vo et al, filed Sep. 30, 1998.

* cited by examiner

BALLISTIC AEROSOL MARKING APPARATUS WITH NON-WETTING COATING

CROSS-REFERENCE TO RELATED APPLICATIONS

This application is a continuation-in-part of application No. 09/163,893, filed Sep. 30, 1998.

The present invention is related to U.S. patent applications Ser. No. 09/163,893, 09/164,124, 09/164,250, 09/163,808, 09/163,765, 09/163,839, 09/163,954, 09/163,924, 09/163,904, 09/163,799, 09/163,664, 09/163,518, 09/164,104, 09/163,825, 08/128,160, 08/670,734, 08/950,300, and 08/950,303, and issued U.S. Pat. No. 5,717,986, each of the above being incorporated herein by reference.

BACKGROUND

The present invention relates generally to the field of marking devices, and more particularly to a device capable of applying a marking material to a substrate by introducing the marking material into a high-velocity propellant stream.

Ink jet is currently a common printing technology. There are a variety of types of ink jet printing, including thermal ink jet (TIJ), piezo-electric ink jet, etc. In general, liquid ink droplets are ejected from an orifice located at a one terminus of a channel. In a TIJ printer, for example, a droplet is ejected by the explosive formation of a vapor bubble within an ink-bearing channel. The vapor bubble is formed by means of a heater, in the form of a resistor, located on one surface of the channel.

We have identified several disadvantages with TIJ (and other ink jet) systems known in the art. For a 300 spot-per-inch (spi) TIJ system, the exit orifice from which an ink droplet is ejected is typically on the order of about 64 $\mu$m in width, with a channel-to-channel spacing (pitch) of about 84 $\mu$m, and for a 600 dpi system width is about 35 $\mu$m and pitch of about 42 $\mu$m. A limit on the size of the exit orifice is imposed by the viscosity of the fluid ink used by these systems. It is possible to lower the viscosity of the ink by diluting it in increasing amounts of liquid (e.g., water) with an aim to reducing the exit orifice width. However, the increased liquid content of the ink results in increased wicking, paper wrinkle, and slower drying time of the ejected ink droplet, which negatively affects resolution, image quality (e.g., minimum spot size, inter-color mixing, spot shape), etc. The effect of this orifice width limitation is to limit resolution of TIJ printing, for example to well below 900 spi, because spot size is a function of the width of the exit orifice, and resolution is a function of spot size.

Another disadvantage of known ink jet technologies is the difficulty of producing greyscale printing. That is, it is very difficult for an ink jet system to produce varying size spots on a printed substrate. If one lowers the propulsive force (heat in a TIJ system) so as to eject less ink in an attempt to produce a smaller dot, or likewise increases the propulsive force to eject more ink and thereby to produce a larger dot, the trajectory of the ejected droplet is affected. This in turn renders precise dot placement difficult or impossible, and not only makes monochrome greyscale printing problematic, it makes multiple color greyscale ink jet printing impracticable. In addition, preferred greyscale printing is obtained not by varying the dot size, as is the case for TIJ, but by varying the dot density while keeping a constant dot size.

Still another disadvantage of common ink jet systems, is rate of marking obtained. Approximately 80% of the time required to print a spot is taken by waiting for the ink jet channel to refill with ink by capillary action. To a certain degree, a more dilute ink flows faster, but raises the problem of wicking, substrate wrinkle, drying time, etc. discussed above.

One problem common to ejection printing systems is that the channels may become clogged. Systems such as TIJ which employ aqueous ink colorants are often sensitive to this problem, and routinely employ non-printing cycles for channel cleaning during operation. This is required since ink typically sits in an ejector waiting to be ejected during operation, and while sitting may begin to dry and lead to clogging.

Other technologies which may be relevant as background to the present invention include electrostatic grids, electrostatic ejection (so-called tone jet), acoustic ink printing, and certain aerosol and atomizing systems such as dye sublimation.

SUMMARY

The present invention is employed in a novel system for applying a marking material to a substrate, directly or indirectly, which overcomes the disadvantages referred to above, as well as others discussed further herein. In particular, the present invention relates to a coating in a port and/or channel which assists in the control and flow of marking material in a system of the type including a propellant which travels through a channel, and a marking material which is controllably (i.e., modifiable in use) introduced, or metered, into the channel such that energy from the propellant propels the marking material to the substrate. The propellant is usually a dry gas which may continuously flow through the channel while the marking apparatus is in an operative configuration (i.e., in a power-on or similar state ready to mark). The system is referred to as "ballistic aerosol marking" in the sense that marking is achieved by in essence launching a non-colloidal, solid or semi-solid particulate, or alternatively a liquid, marking material at a substrate. The shape of the channel may result in a collimated (or focused) flight of the propellant and marking material onto the substrate.

In our system, the propellant may be introduced at a propellant port into the channel to form a propellant stream. A marking material may then be introduced into the propellant stream from one or more marking material inlet ports. The propellant may enter the channel at a high velocity. Alternatively, the propellant may be introduced into the channel at a high pressure, and the channel may include a constriction (e.g., de Laval or similar converging/diverging type nozzle) for converting the high pressure of the propellant to high velocity. In such a case, the propellant is introduced at a port located at a proximal end of the channel (defined as the converging region), and the marking material ports are provided near the distal end of the channel (at or further down-stream of a region defined as the diverging region), allowing for introduction of marking material into the propellant stream.

In the case where multiple ports are provided, each port may provide for a different color (e.g., cyan, magenta, yellow, and black), pre-marking treatment material (such as a marking material adherent), post-marking treatment material (such as a substrate surface finish material, e.g., matte or gloss coating, etc.), marking material not otherwise visible to the unaided eye (e.g., magnetic particle-bearing material, ultra violet-fluorescent material, etc.) or other marking material to be applied to the substrate. The marking material is imparted with kinetic energy from the propellant stream, and ejected from the channel at an exit orifice located at the distal end of the channel in a direction toward a substrate.

One or more such channels may be provided in a structure which, in one embodiment, is referred to herein as a print head. The width of the exit (or ejection) orifice of a channel is generally on the order of 250 $\mu$m or smaller, preferably in the range of 100 $\mu$m or smaller. Where more than one channel is provided, the pitch, or spacing from edge to edge (or center to center) between adjacent channels may also be on the order of 250 $\mu$m or smaller, preferably in the range of 100 $\mu$m or smaller. Alternatively, the channels may be staggered, allowing reduced edge-to-edge spacing.

The material to be applied to the substrate may be transported to a port by one or more of a wide variety of ways, including simple gravity feed, hydrodynamic, electrostatic, or ultrasonic transport, etc. The material may be metered out of the port into the propellant stream also by one of a wide variety of ways, including control of the transport mechanism, or a separate system such as pressure balancing, electrostatics, acoustic energy, ink jet, etc.

The material to be applied to the substrate may be a solid or semi-solid particulate material such as a toner or variety of toners in different colors, a suspension of such a marking material in a carrier, a suspension of such a marking material in a carrier with a charge director, a phase change material, etc., both visible and non-visible. One preferred embodiment employs a marking material which is particulate, solid or semi-solid, and dry or suspended in a liquid carrier. Such a marking material is referred to herein as a particulate marking material. This is to be distinguished from a liquid marking material, dissolved marking material, atomized marking material, or similar non-particulate material, which is generally referred to herein as a liquid marking material. However, the present invention is able to utilize such a liquid marking material in certain applications, as otherwise described herein. Indeed, the present invention may also be employed in the use of non-marking materials, such as marking pre- and post-treatments, finishes, curing or sealing materials, etc., and accordingly the present disclosure and claims should be read to broadly encompass the transport and marking of wide variety of materials.

According to one embodiment of the present invention, a hydrophobic coating is employed to control the location of a meniscus of marking material in a port which connects a marking material reservoir and a channel. By controlling the location of the meniscus, improved control of the delivery of marking material into the channel, and ultimately to the substrate, may be obtained. The meniscus may be located at the reservoir end of the port, the channel end of the port, or somewhere in-between.

Thus, the present invention and its various embodiments provide numerous advantages discussed above, as well as additional advantages which will be described in further detail below.

BRIEF DESCRIPTION OF THE DRAWINGS

A more complete appreciation of the invention and many of the attendant advantages thereof will be readily obtained and understood by referring to the following detailed description and the accompanying drawings in which like reference numerals denote like elements as between the various drawings. The drawings, briefly described below, are not to scale.

DETAILED DESCRIPTION

In the following detailed description, numeric ranges are provided for various aspects of the embodiments described, such as pressures, velocities, widths, lengths, etc. These recited ranges are to be treated as examples only, and are not intended to limit the scope of the claims hereof. In addition, a number of materials are identified as suitable for various facets of the embodiments, such as for marking materials, propellants, body structures, etc. These recited materials are also to be treated as exemplary, and are not intended to limit the scope of the claims hereof.

Figure 1:
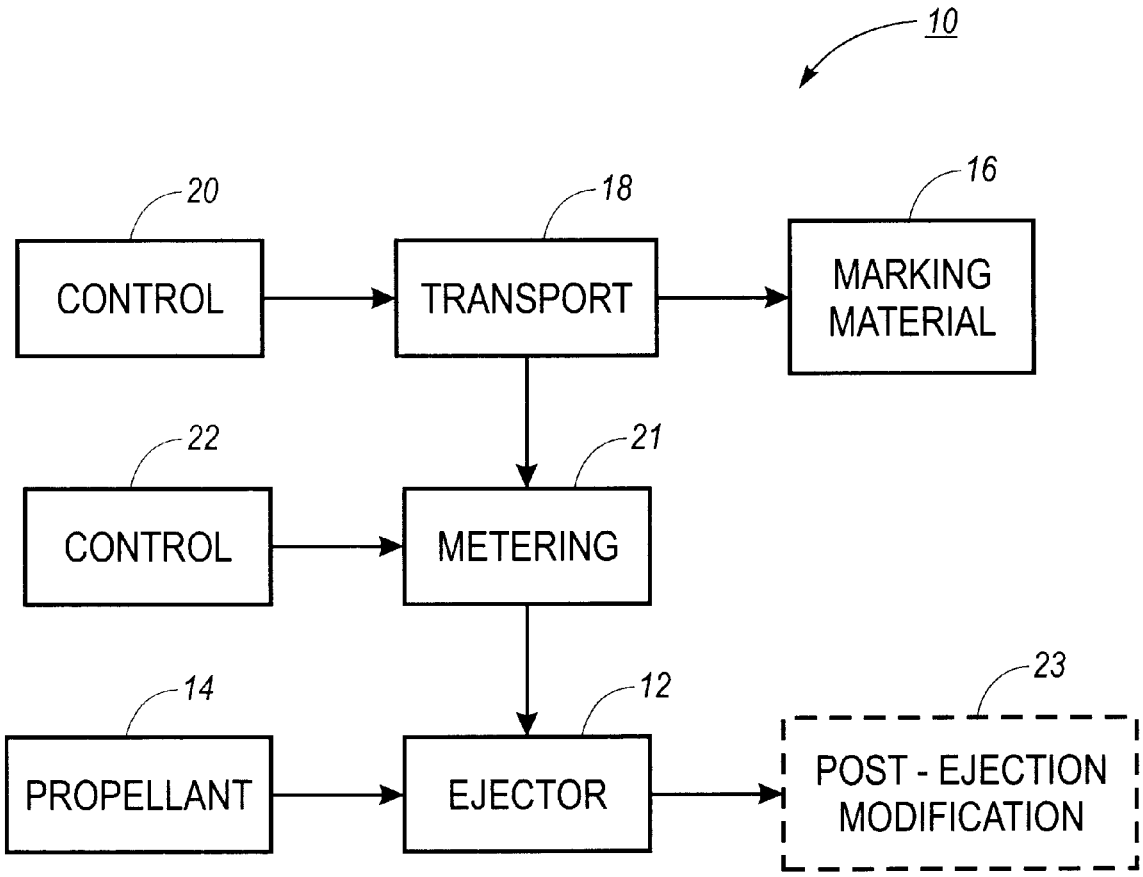
FIG. 1 is a schematic illustration of a system for marking a substrate according to the present invention.

With reference now to FIG. 1, shown therein is a schematic illustration of a ballistic aerosol marking device 10 according to one embodiment of the present invention. As shown therein, device 10 consists of one or more ejectors 12 to which a propellant 14 is fed. A marking material 16, which may be transported by a transport 18 under the control of control 20 is introduced into ejector 12. (Optional elements are indicated by dashed lines.) The marking material is metered (that is controllably introduced) into the ejector by metering means 21, under control of control 22. The marking material ejected by ejector 12 may be subject to post ejection modification 23, optionally also part of device 10. It will be appreciated that device 10 may form a part of a printer, for example of the type commonly attached to a computer network, personal computer or the like, part of a facsimile machine, part of a document duplicator, part of a labeling apparatus, or part of any other of a wide variety of marking devices.

Figure 2:
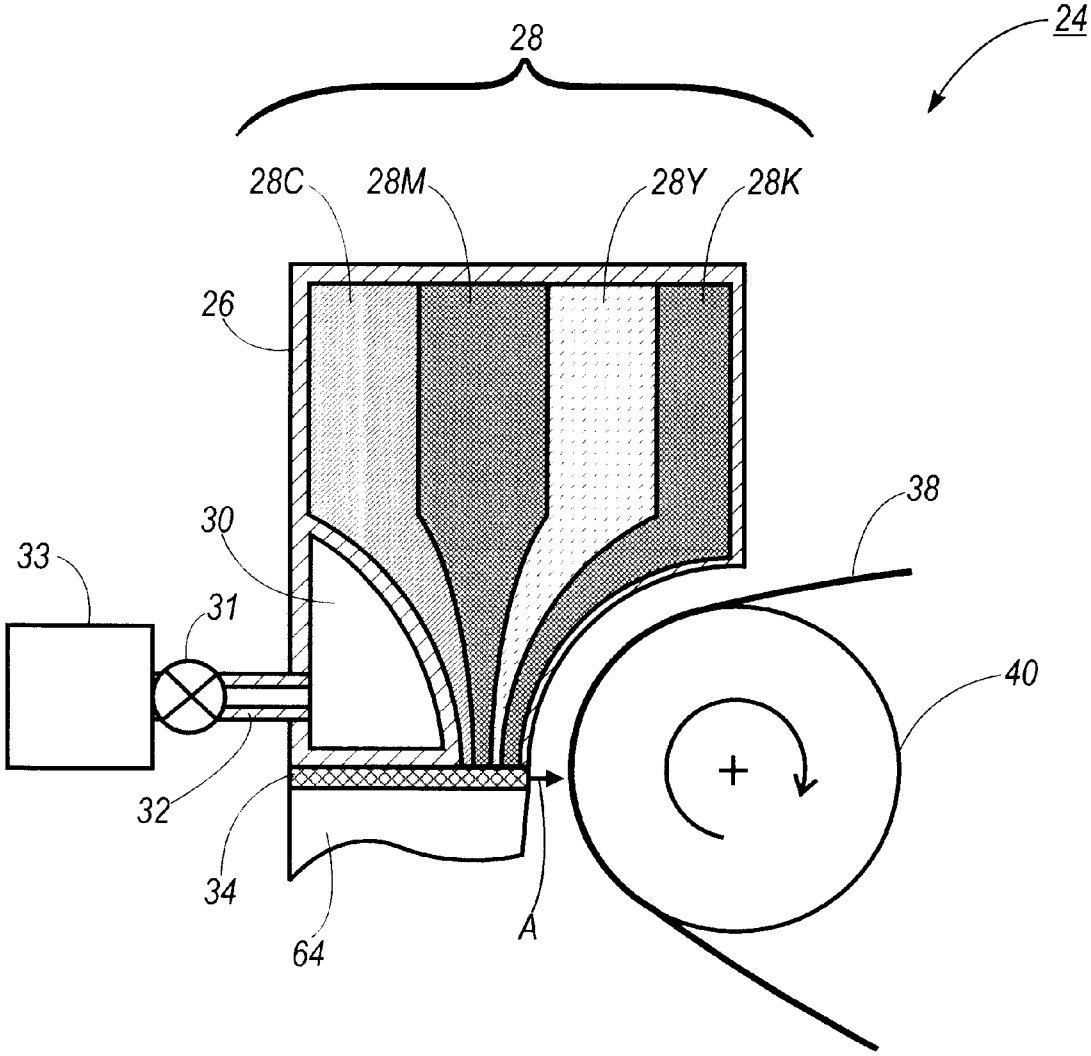
FIG. 2 is cross sectional illustration of a marking apparatus according to one embodiment of the present invention.

The embodiment illustrated in FIG. 1 may be realized by a ballistic aerosol marking device 24 of the type shown in the cut-away side view of FIG. 2. According to this embodiment, the materials to be deposited will be 4 colored toners, for example cyan (C), magenta (M), yellow (Y), and black (K), of a type described further herein, which may be deposited concomitantly, either mixed or unmixed, successively, or otherwise. While the illustration of FIG. 2 and the associated description contemplates a device for marking with four colors (either one color at a time or in mixtures thereof), a device for marking with a fewer or a greater number of colors, or other or additional materials such as materials creating a surface for adhering marking material particles (or other substrate surface pre-treatment), a desired substrate finish quality (such as a matte, satin or gloss finish or other substrate surface post-treatment), material not visible to the unaided eye (such as magnetic particles, ultra violet-fluorescent particles, etc.) or other material associated with a marked substrate, is clearly contemplated herein.

Device 24 consists of a body 26 within which is formed a plurality of cavities 28C, 28M, 28Y, and 28K (collectively referred to as cavities 28) for receiving materials to be deposited. Also formed in body 26 may be a propellant cavity 30. A fitting 32 may be provided for connecting propellant cavity 30 to a propellant source 33 such as a compressor, a propellant reservoir, or the like. Body 26 may be connected to a print head 34, comprised of among other layers, substrate 36 and channel layer 37 that will be discussed later.

Figure 3:
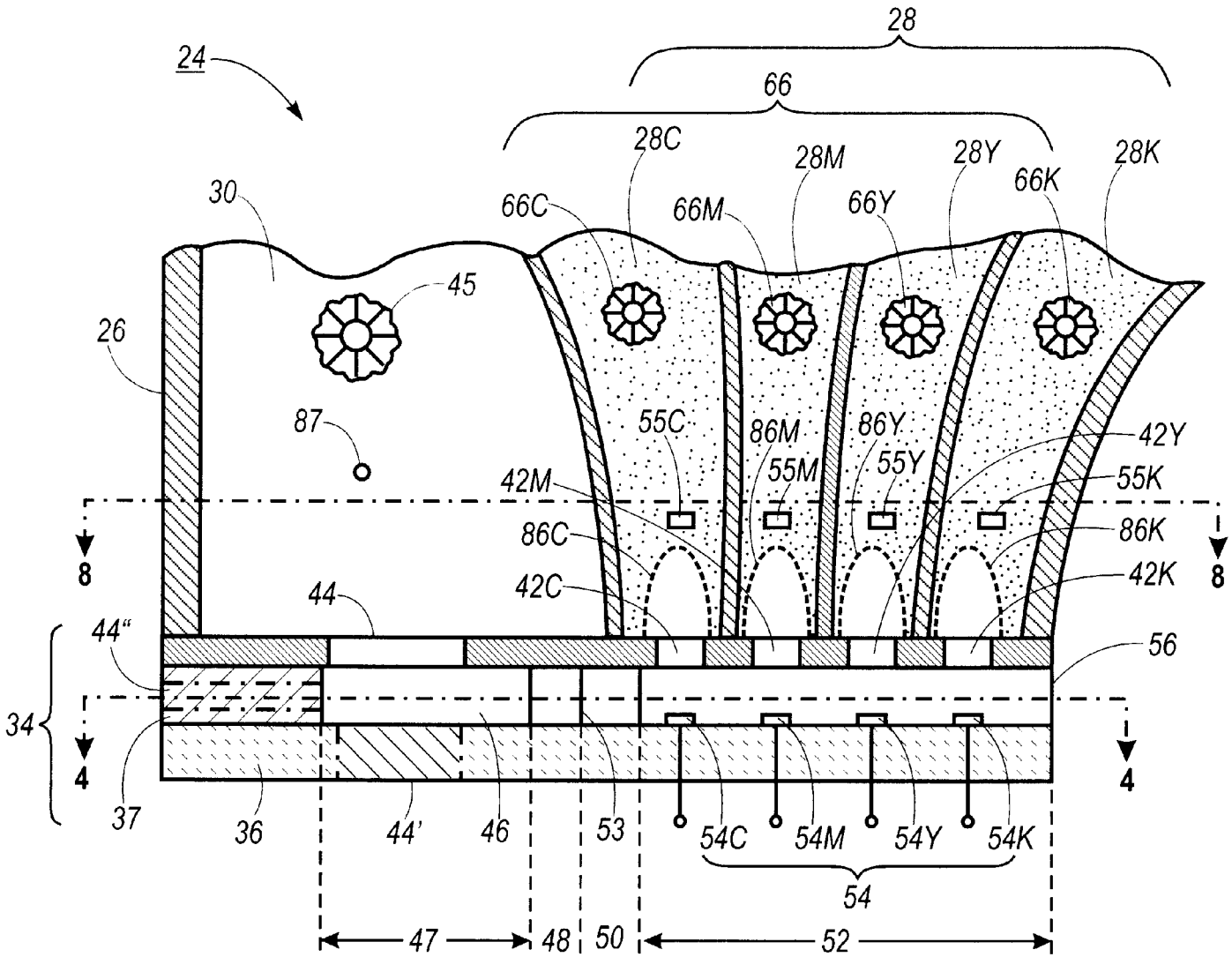
FIG. 3 is another cross sectional illustration of a marking apparatus according to one embodiment of the present invention.

With reference now to FIG. 3, shown therein is a cut-away cross section of a portion of device 24. Each of cavities 28 include a port 42C, 42M, 42Y, and 42K (collectively referred to as ports 42) respectively, of circular, oval, rectangular or other cross-section, providing communication between said cavities and a channel 46 which adjoins body 26. Ports 42 are shown having a longitudinal axis roughly perpendicular to the longitudinal axis of channel 46. However, the angle between the longitudinal axes of ports 42 and channel 46 may be other than 90 degrees, as appropriate for the particular application of the present invention.

Likewise, propellant cavity 30 includes a port 44, of circular, oval, rectangular or other cross-section, between said cavity and channel 46 through which propellant may travel. Alteratively, print head 34 may be provided with a port 44' in substrate 36 or port 44" in channel layer 37, or combinations thereof, for the introduction of propellant into channel 46. As will be described further below, marking material is caused to flow out from cavities 28 through ports 42 and into a stream of propellant flowing through channel 46. The marking material and propellant are directed in the direction of arrow A toward a substrate 38, for example paper, supported by a platen 40, as shown in FIG. 2. We have experimentally demonstrated a propellant marking material flow pattern from a print head employing a number of the features described herein which remains relatively collimated for a distance of up to 10 millimeters, with an optimal printing spacing on the order of between one and several millimeters. For example, the print head produces a marking material stream which does not deviate by more than between 20 percent, and preferably by not more than 10 percent, from the width of the exit orifice for a distance of at least 4 times the exit orifice width. However, the appropriate spacing between the print head and the substrate is a function of many parameters, and does not itself form a part of the present invention.

Referring again to FIG. 3, according to one embodiment of the present invention, print head 34 consists of a substrate 36 and channel layer 37 in which is formed channel 46. Additional layers, such as an insulating layer, capping layer, etc. (not shown) may also form a part of print head 34. Substrate 36 is formed of a suitable material such as glass, ceramic, etc., on which (directly or indirectly) is formed a relatively thick material, such as a thick permanent photoresist (e.g., a liquid photosensitive epoxy such as SU-8, from Microlithography Chemicals, Inc; see also U.S. patent Ser. No. 4,882,245) and/or a dry film-based photoresist such as the Riston photopolymer resist series, available from DuPont Printed Circuit Materials, Research Triangle Park, N.C. (see, www.dupont.com/pcm/) which may be etched, machined, or otherwise in which may be formed a channel with features described below.

Figure 4:
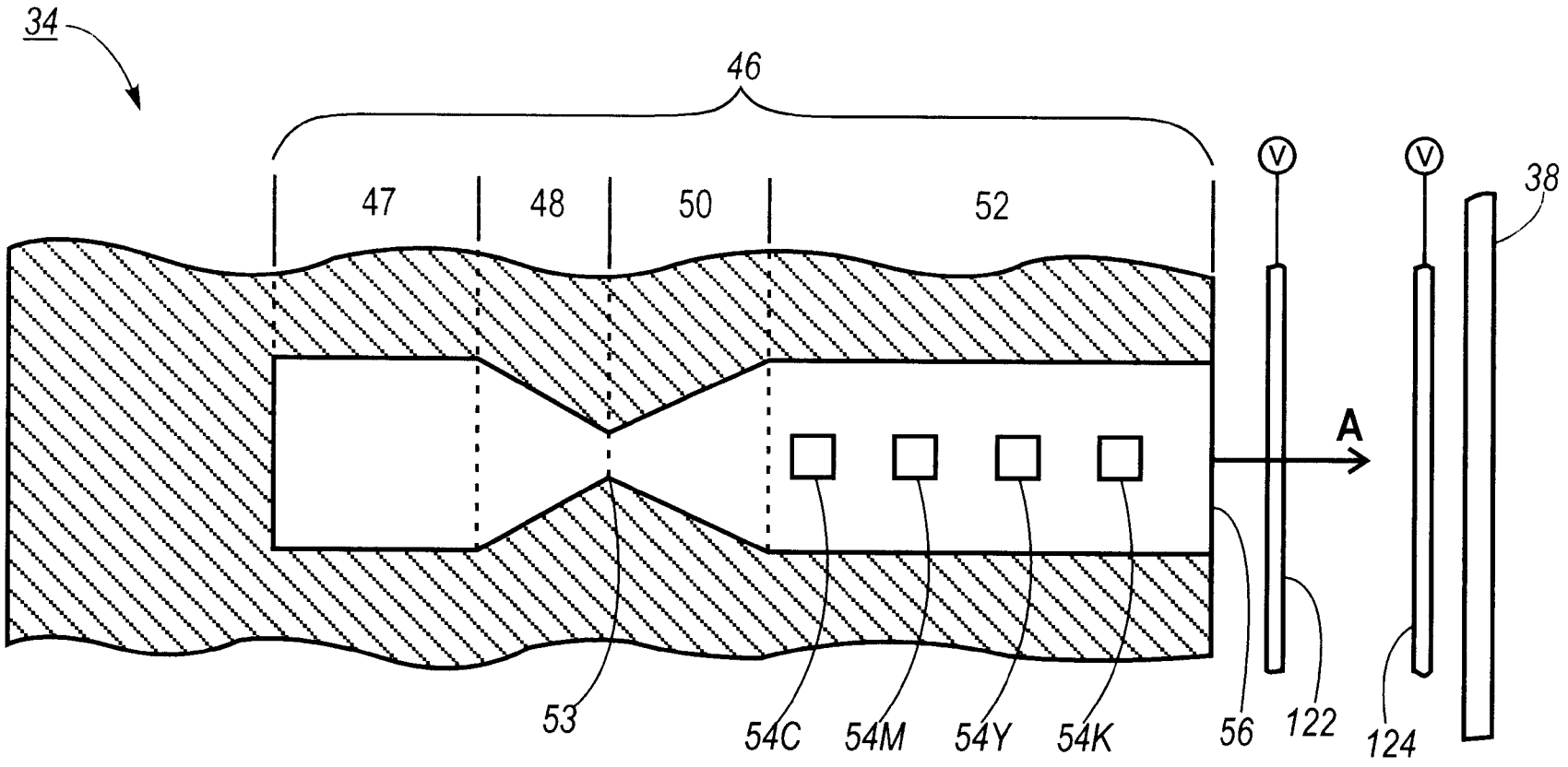
FIG. 4 is a plan view of one channel, with nozzle, of the marking apparatus shown in FIG. 3.

Referring now to FIG. 4, which is a cut-away plan view of print head 34, in one embodiment channel 46 is formed to have at a first, proximal end a propellant receiving region 47, an adjacent converging region 48, a diverging region 50, and a marking material injection region 52. The point of transition between the converging region 48 and diverging region 50 is referred to as throat 53, and the converging region 48, diverging region 50, and throat 53 are collectively referred to as a nozzle. The general shape of such a channel is sometimes referred to as a de Laval expansion pipe. An exit orifice 56 is located at the distal end of channel 46.

Referring again to FIG. 3, propellant enters channel 46 through port 44, from propellant cavity 30, roughly perpendicular to the long axis of channel 46. According to another embodiment, the propellant enters the channel parallel (or at some other angle) to the long axis of channel 46 by, for example, ports 44' or 44" or other manner not shown. The propellant may continuously flow through the channel while the marking apparatus is in an operative configuration (e.g., a "power on" or similar state ready to mark), or may be modulated such that propellant passes through the channel only when marking material is to be ejected, as dictated by the particular application of the present invention. Such propellant modulation may be accomplished by a valve 31 interposed between the propellant source 33 and the channel 46, by modulating the generation of the propellant for example by turning on and off a compressor or selectively initiating a chemical reaction designed to generate propellant, or by other means not shown.

Marking material may controllably enter the channel through one or more ports 42 located in the marking material injection region 52. That is, during use, the amount of marking material introduced into the propellant stream may be controlled from zero to a maximum per spot. The propellant and marking material travel from the proximal end to a distal end of channel 46 at which is located exit orifice 56.

Figure 5A:
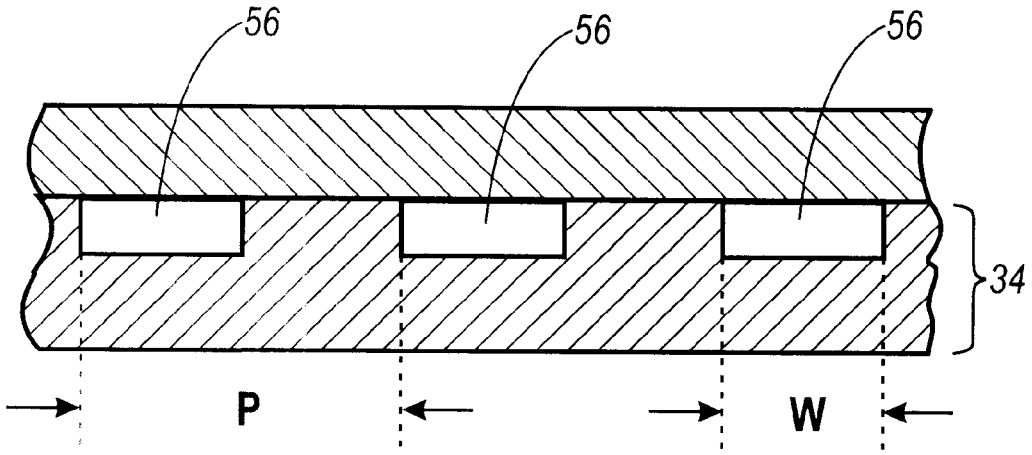
FIGS. 5A and 5B are end views of non-staggered and two-dimensionally staggered arrays of channels according to the present invention.
Figure 5B:
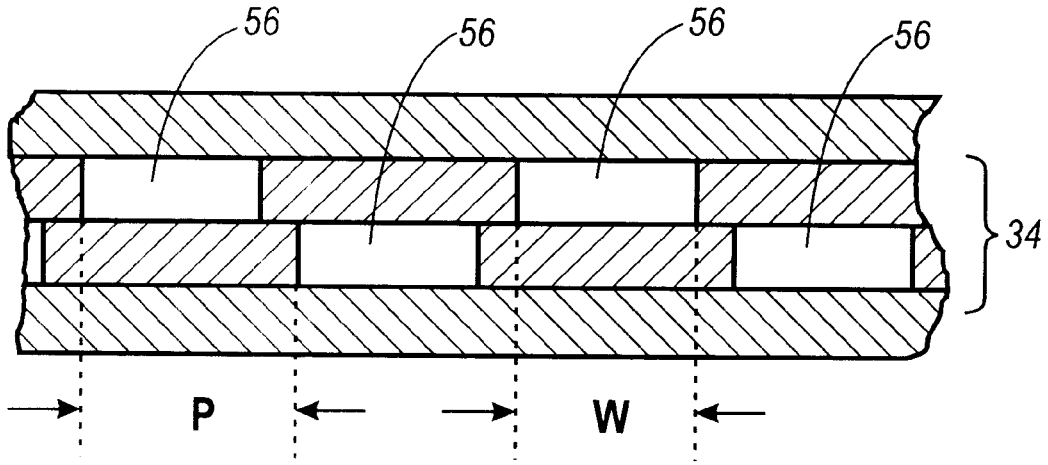

While FIG. 4 illustrates a print head 34 having one channel therein, it will be appreciated that a print head according to the present invention may have an arbitrary number of channels, and range from several hundred micrometers across with one or several channels, to a page-width (e.g., 8.5 or more inches across) with thousands of channels. The width W of each exit orifice 56 may be on the order of 250 $\mu$m or smaller, preferably in the range of 100 $\mu$m or smaller. The pitch P, or spacing from edge to edge (or center to center) between adjacent exit orifices 56 may also be on the order of 250 $\mu$m or smaller, preferably in the range of 100 $\mu$m or smaller in non-staggered array, illustrated in end view in FIG. 5A. In a two-dimensionally staggered array, of the type shown in FIG. 5B, the pitch may be further reduced. For example, Table 1 illustrates typical pitch and width dimensions for different resolutions of a non-staggered array.

TABLE 1

| Resolution | Pitch | Width |
|---|---|---|
| 300 | 84 | 60 |
| 600 | 42 | 30 |
| 900 | 32 | 22 |
| 1200 | 21 | 15 |

Figure 6:
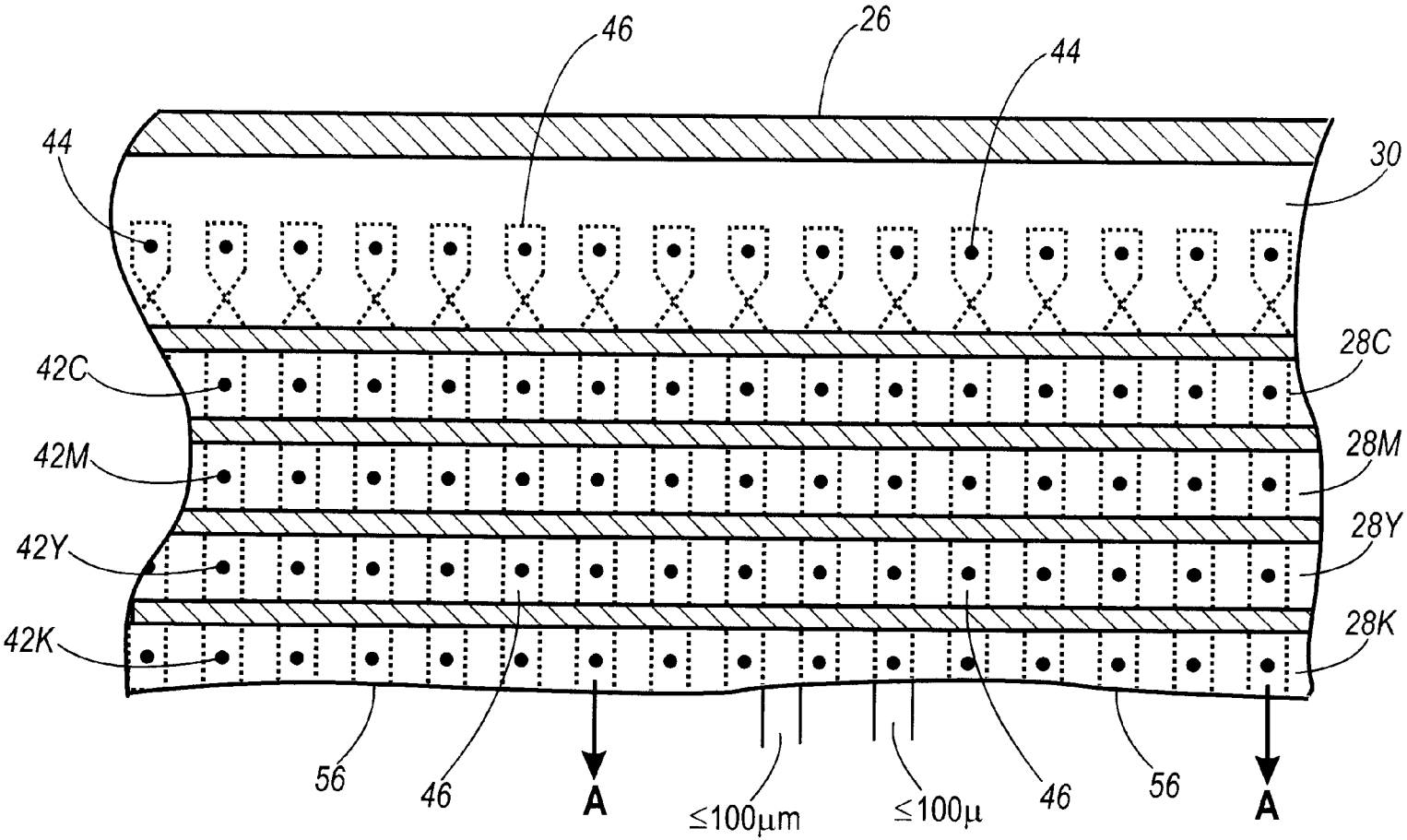
FIG. 6 is a plan view of an array of channels of an apparatus according to one embodiment of the present invention.
Figure 7A:
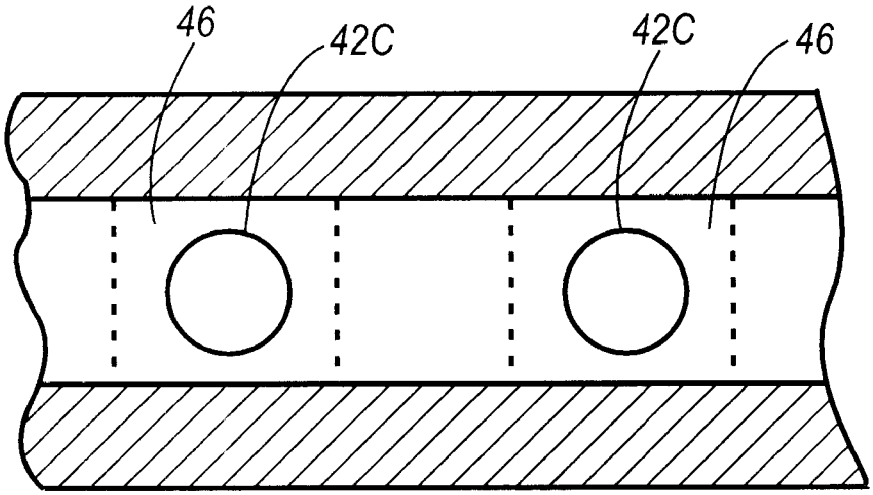
FIGS. 7A and 7B are plan views of a portion of the array of channels shown in FIG. 6, illustrating two embodiments of ports according to the present invention.
Figure 7B:
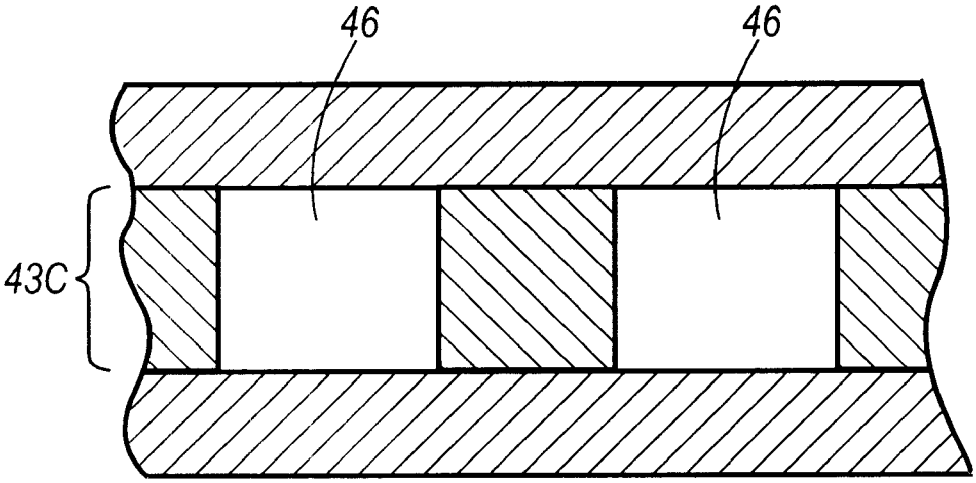

As illustrated in FIG. 6, a wide array of channels in a print head may be provided with marking material by continuous cavities 28, with ports 42 associated with each channel 46. Likewise, a continuous propellant cavity 30 may service each channel 46 through an associated port 44. Ports 42 may be discrete openings in the cavities, as illustrated in FIG. 7A, or may be formed by a continuous opening 43 (illustrated by one such opening 43C) extending across the entire array, as illustrated in FIG. 7B.

Device Operation

Figure 12:
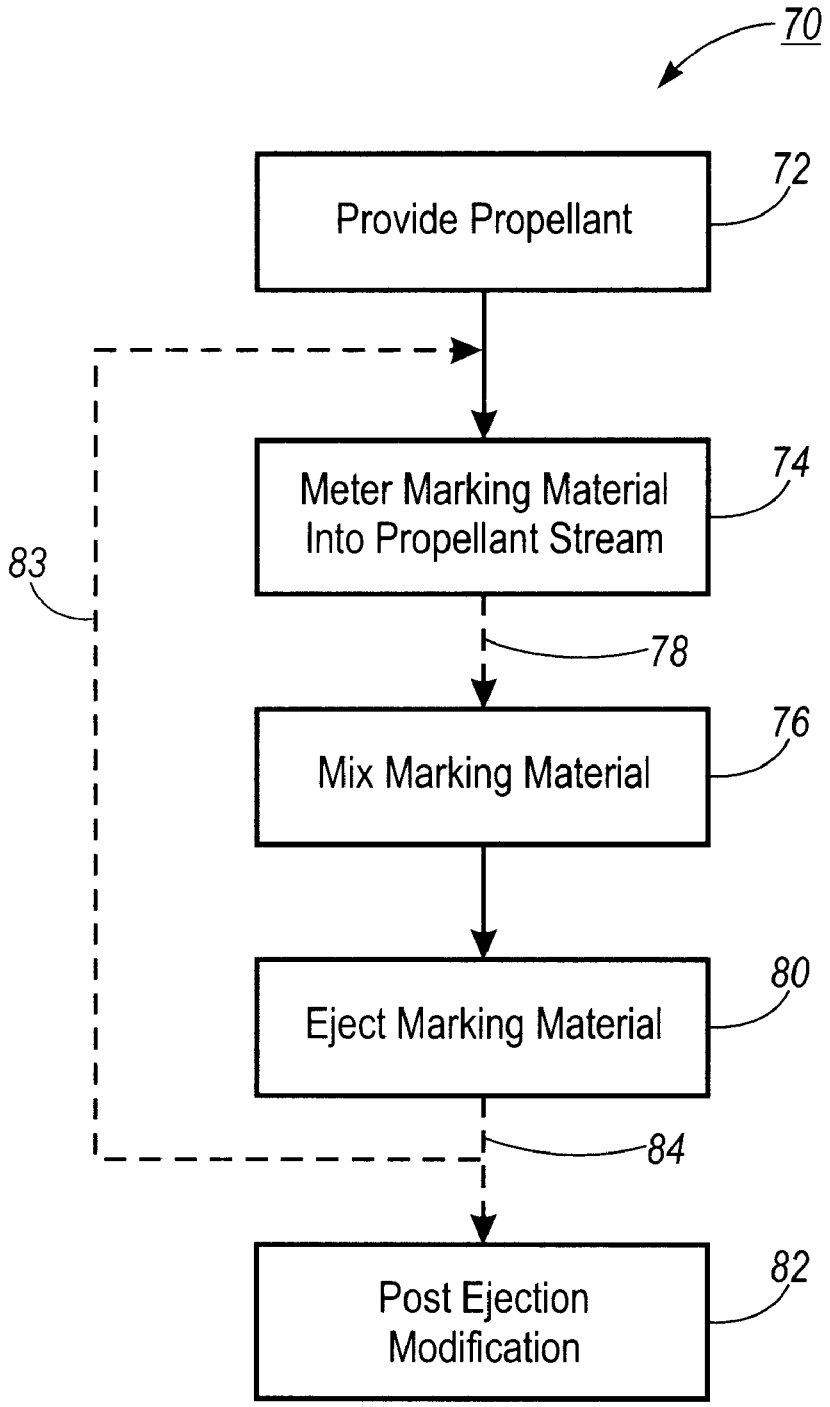
FIG. 12 is a process flow diagram for the marking of a substrate according to the present invention.

The process 70 involved in the marking of a substrate with marking material according to the present invention is illustrated by the steps shown in FIG. 12.. According to step 72, a propellant is provided to a channel. A marking material is next metered into the channel at step 74. In the event that the channel is to provide multiple marking materials to the substrate, the marking materials may be mixed in the channel at step 76 so as to provide a marking material mixture to the substrate. By this process, one-pass color marking, without the need for color registration, may be obtained. An alternative for one-pass color marking is the sequential introduction of multiple marking materials while maintaining a constant registration between print head 34 and substrate 38. Since, not every marking will be composed of multiple marking materials, this step is optional as represented by the dashed arrow 78. At step 80, the marking material is ejected from an exit orifice at a distal end of the channel, in a direction toward, and with sufficient energy to reach a substrate. The process may be repeated with reregistering the print head, as indicated by arrow 83. Appropriate post ejection treatment, such as fusing, drying, etc. of the marking material is performed at step 82, again optional as indicated by the dashed arrow 84.

Marking Material

According to one embodiment of the present invention a solid, particulate marking material is employed for marking a substrate. The marking material particles may be on the order of 0.5 to 10.0 $\mu$m, preferably in the range of 1 to 5 $\mu$m, although sizes outside of these ranges may function in specific applications (e.g., larger or smaller ports and channels through which the particles must travel).

There are several advantages provided by the use of solid, particulate marking material. First, clogging of the channel is minimized as compared, for example, to liquid inks. Second, wicking and running of the marking material (or its carrier) upon the substrate, as well as marking material substrate interaction may be reduced or eliminated. Third, spot position problems encountered with liquid marking material caused by surface tension effects at the exit orifice are eliminated. Fourth, channels blocked by gas bubbles retained by surface tension are eliminated. Fifth, multiple marking materials (e.g., multiple colored toners) can be mixed upon introduction into a channel for single pass multiple material (e.g., multiple color) marking, without the risk of contaminating the channel for subsequent markings (e.g., pixels). Registration overhead (equipment, time, related print artifacts, etc.) is thereby eliminated. Sixth, the channel refill portion of the duty cycle (up to 80% of a TIJ duty cycle) is eliminated. Seventh, there is no need to limit the substrate throughput rate based on the need to allow a liquid marking material to dry.

However, despite any advantage of a dry, particulate marking material, there may be some applications where the use of a liquid marking material, or a combination of liquid and dry marking materials, may be beneficial. In such instances, the present invention may be employed, with simply a substitution of the liquid marking material for the solid marking material and appropriate process and device changes apparent to one skilled in the art or described herein, for example substitution of metering devices, etc.

In certain applications of the present invention, it may be desirable to apply a substrate surface-pre-marking treatment. For example, in order to assist with the fusing of particulate marking material in the desired spot locations, it may be beneficial to first coat the substrate surface with an adherent layer tailored to retain the particulate marking material. Examples of such material include clear and/or colorless polymeric materials such as homopolymers, random copolymers or block copolymers that are applied to the substrate as a polymeric solution where the polymer is dissolved in a low boiling point solvent. The adherent layer is applied to the substrate ranging from 1 to 10 microns in thickness or preferably from about 5 to 10 microns thick. Examples of such materials are polyester resins either linear or branched, poly(styrenic) homopolymers, poly(acrylate) and poly (methacrylate) homopolymers and mixtures thereof, or random copolymers of styrenic monomers with acrylate, methacrylate or butadiene monomers and mixtures thereof, polyvinyl acetals, poly(vinyl alcohol), vinyl alcohol-vinyl acetal copolymers, polycarbonates and mixtures thereof and the like. This surface pre-treatment may be applied from channels of the type described herein located at the leading edge of a print head, and may thereby apply both the pre-treatment and the marking material in a single pass. Alternatively, the entire substrate may be coated with the pre-treatment material, then marked as otherwise described herein. See U.S. patent application Ser. No. 08/041,353, incorporated herein by reference. Furthermore, in certain applications it may be desirable to apply marking material and pre-treatment material simultaneously, such as by mixing the materials in flight, as described further herein.

Likewise, in certain applications of the present invention, it may be desirable to apply a substrate surface post-marking treatment. For example, it may be desirable to provide some or all of the marked substrate with a gloss finish. In one example, a substrate is provided with marking comprising both text and illustration, as otherwise described herein, and it is desired to selectively apply a gloss finish to the illustration region of the marked substrate, but not the text region. This may be accomplished by applying the post-marking treatment from channels at the trailing edge of the print head, to thereby allow for one-pass marking and post-marking treatment. Alternatively, the entire substrate may be marked as appropriate, then passed through a marking device according to the present invention for applying the post-marking treatment. Furthermore, in certain applications it may be desirable to apply marking material and post-treatment material simultaneously, such as by mixing the materials in flight, as described further herein. Examples of materials for obtaining a desired surface finish include polyester resins either linear or branched, poly (styrenic) homopolymers, poly(acrylate) and poly (methacrylate) homopolymers and mixtures thereof, or random copolymers of styrenic monomers with acrylate, methacrylate or butadiene monomers and mixtures thereof, polyvinyl acetals, poly(vinyl alcohol), vinyl alcohol-vinyl acetal copolymers, polycarbonates, and mixtures thereof and the like.

Other pre- and post-marking treatments include the underwriting/overwriting of markings with marking material not visible to the unaided eye, document tamper protection coatings , security encoding, for example with wavelength specific dyes or pigments that can only be detected at a specific wavelength (e.g., in the infrared or ultraviolet range) by a special decoder, and the like. See U.S. Pat. No. 5,208, 630, U.S. Pat. No. 5,385,803, and U.S. Pat. No. 5,554,480, each incorporated herein by reference. Still other pre- and post-marking treatments include substrate or surface texture, coatings (e.g. to create embossing effects, to simulate an arbitrarily rough or smooth substrate), materials designed to have a physical or chemical reaction at the substrate (e.g., two materials which, when combined at the substrate, cure or otherwise cause a reaction to affix the marking material to the substrate), etc. It should be noted, however, that references herein to apparatus and methods for transporting, metering, containing, etc. marking material should be equally applicable to pre- and post-marking treatment material (and in general, to other non-marking material) unless otherwise noted or as may be apparent to one skilled in the art.

Port and/or Channel Coating

An important aspect of controlling the amount of marking material delivered to the channel (and ultimately to the substrate) is the ability to control the marking material in the port. Of particular importance to the present discussion are the cases involving a liquid or liquid-like carrier in which particulate marking material is suspended, and liquid marking material.

Figure 8:
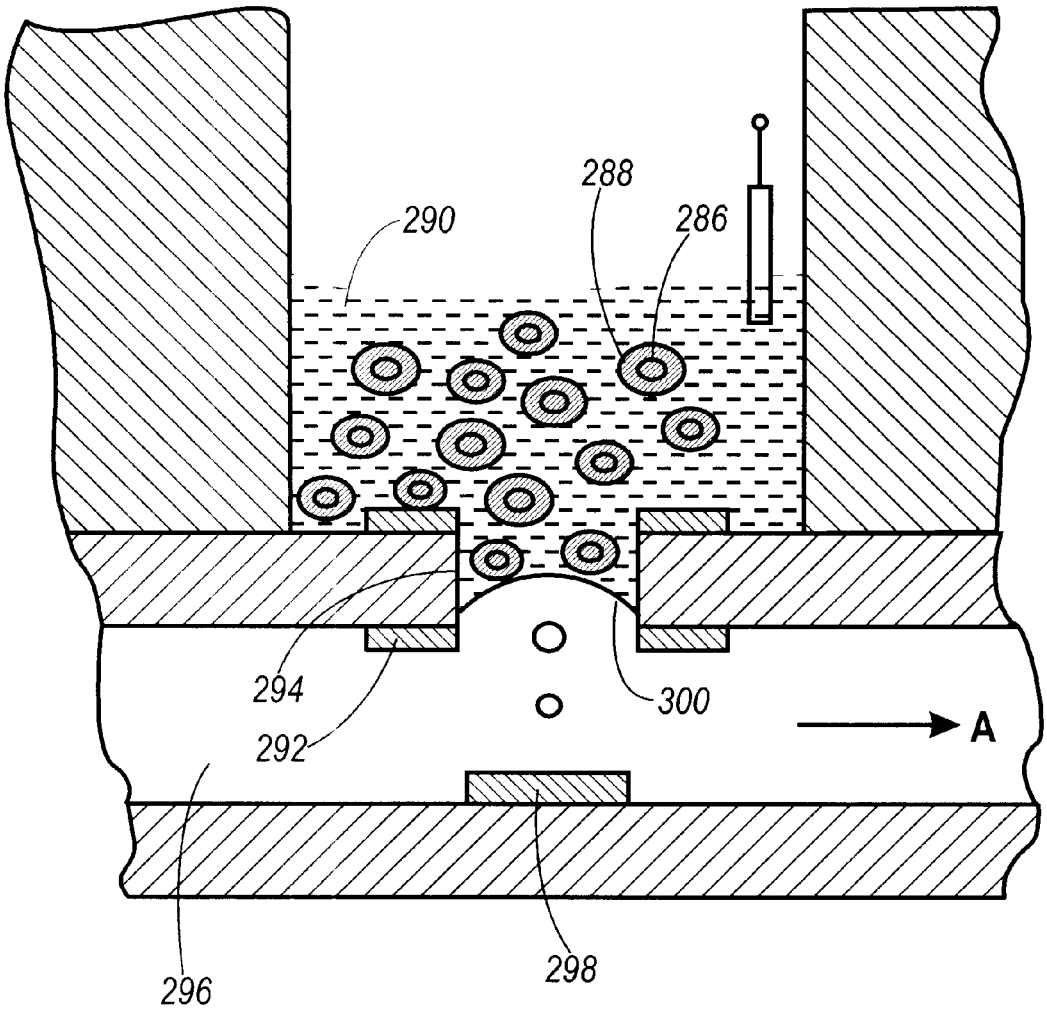
FIG. 8 is an illustration of one embodiment of the present invention employing particulate marking materials suspended in a liquid carrier medium.
Figure 9:
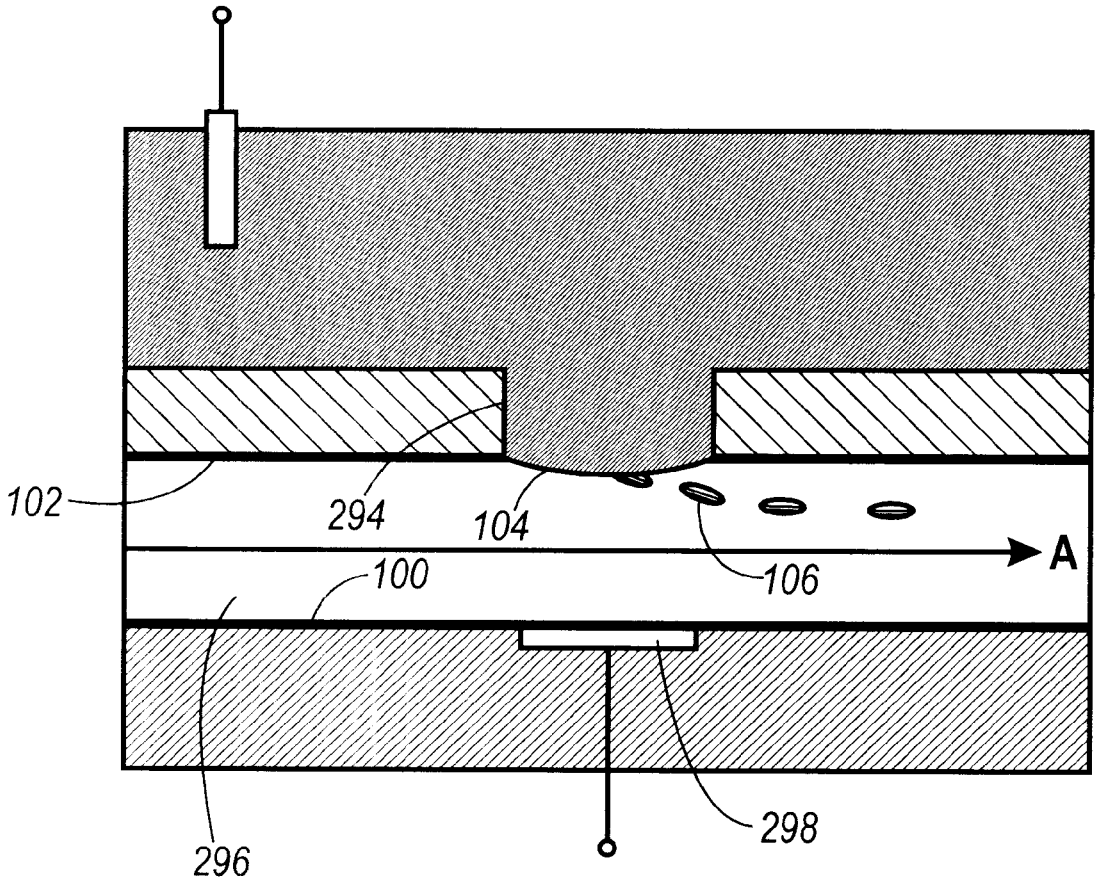
FIG. 9 is cross-section view of a channel, port, and marking material reservoir with non-wetting coating according to one embodiment of the present invention.

As has been alluded to, marking material may be either solid particulate material or liquid. However, within this set there are several alternatives. For example, apart from a mere collection of solid particles, a solid marking material may be suspended in a gaseous (i.e., aerosol) or liquid carrier. Other examples include multi-phase materials. With reference to FIG. 8, in one such material, solid marking material particles 286 are suspended in a pool 290 of the carrier medium. The carrier medium may be a colorless dielectric which lends liquid flow properties to the marking material. The solid marking material particles 286 may be on the order of 1–2 $\mu$m, and provided with a net charge. The charged marking material particles 286 may be attracted by the field generated by appropriate electrodes 292 located proximate the port 294, and directed into channel 296. A supplemental electrode 298 may assist with the extraction of the marking material particles 286. A meniscus 300 forms in port 294. When the particle 286/carrier 288 combination is pulled through the meniscus 300, surface tension causes particle 286 to pull out of the carrier medium 288 leaving only a thin film of carrier medium on the surface of the particle. This thin film may be beneficially employed, in that it may cause adhesion of the particle 286 to most substrate types, especially at low velocity, allowing for particle position retention prior to post-ejection modification (e.g., fusing). We have determined that the location of the meniscus 300 can have an impact on the control over the amount of marking material introduced into the channel. For example, a meniscus 104 located at the channel end of the port 294 and which extends into the channel may have the effect that marking material, such as droplets 106, would be pulled into a propellant stream in the channel, as illustrated in FIG. 9. In the case of a liquid marking material, this may be acceptable, even desirable. However, in the case of a suspended particulate marking material, for example of the type illustrated in FIG. 8, this would be undesirable as it may cause not only marking material to enter the channel but also liquid carrier medium. Likewise, a meniscus located at the reservoir end of port 294 may be preferred for the case of suspended particulate marking material, but may be problematic for liquid marking material in that more field strength would be required to extract liquid droplets, the control of the droplet size would be reduced, etc.

We have developed an effective way to control the location of the meniscus, for example for the purposes described above (although there may be additional reasons to control such a location). According to one embodiment of this invention, a hydrophobic coating is applied to one or more surfaces of the interior of channel 296, such as walls 100 and 102 to render those surfaces non-wetting. We have found that spin-coating or dipping the channel structure in a low viscosity, non-wetting material is an effective means of applying the coating. We have found that a commercial fluorinated polymer from 3M Corp., with the product name Fluorad FC-725 Conformal Coating is effective for the above-described purposes (see www.mmm.com/US/mfg_industrial/perfchem/prodinfo/electron/FC725). Plasma deposition is another conformal process that would be effective in depositing an appropriate coating. A dry coating of a fluorinated polymer (such as a CF3- or CH4-based plasma) low surface energy film should also serve the aforementioned purposes. An alterative would be to fabricate the walls, body, etc. forming the channel of an appropriate non-wetting material, such as machined PTFE, etc., would also serve the present goals.

Figure 10:
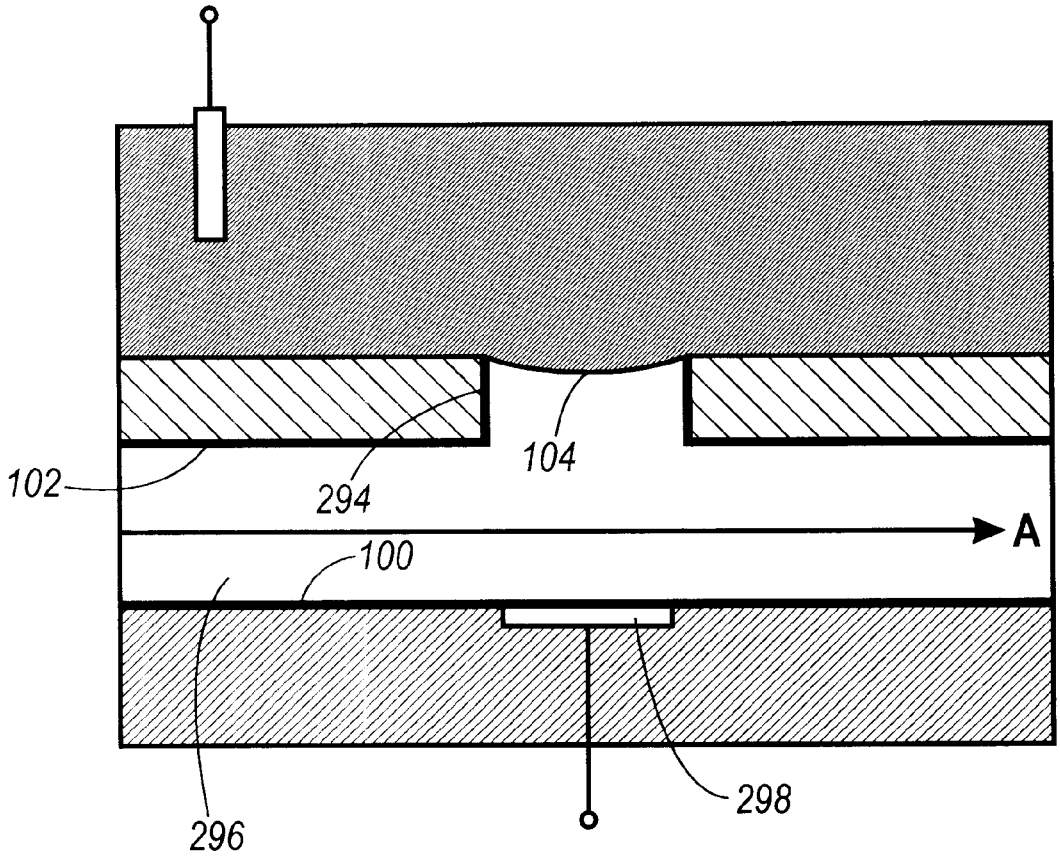
FIG. 10 is a cross-section view of a channel, port, and marking material reservoir with non-wetting coating according to another embodiment of the present invention.

FIG. 10 illustrates another embodiment of the present invention in which the walls of port 294 have a non-wetting surface. In so doing, the meniscus 104 is confined to the reservoir end of port 294, removed from a propellant stream in channel 296. The non-wetting surfaces may be provided by the above-mentioned techniques and materials. In this, or appropriate other embodiments of the present invention the interior surfaces of the marking material reservoir may optionally have a non-wetting coating (not shown).

Figure 11:
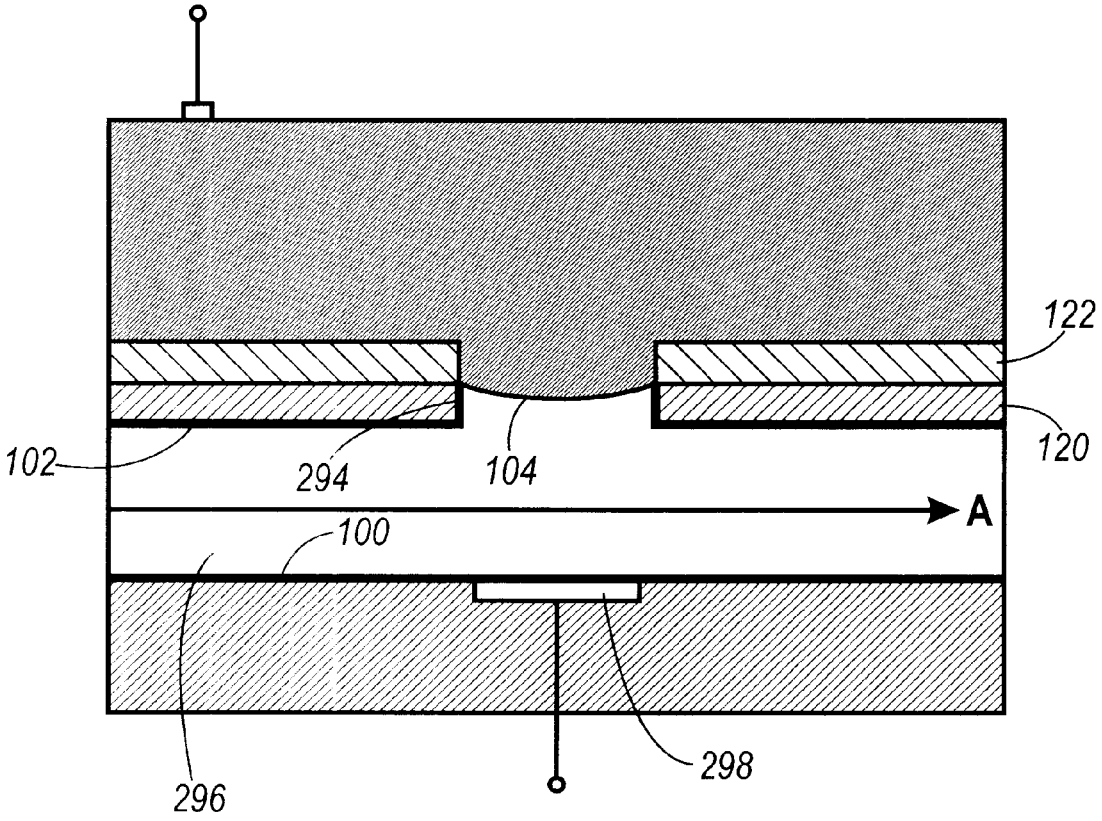
FIG. 11 is, cross-section view of a channel, port, and marking material reservoir with non-wetting coating according to still another embodiment of the present invention.

FIG. 1 1 illustrates still another embodiment of the present invention in which only a selected portion of the walls of port 294 are provided with a non-wetting surface. This may be done for a variety of reasons, for example to balance the reduced field strength required to extract marking material due to the proximity of the marking material to electrode 298 against the effects of a propellant stream on the nature and quantity of marking material extracted into the channel. A multi-layered structure shown in FIG. 11 may be employed, where the relative thicknesses of layers 120 and 122 determined the extend of the coating on the walls of port 294.

It will now be appreciated that various embodiments of a ballistic aerosol marking apparatus, and specifically non-wetting coatings therefor, have been disclosed herein. These embodiments encompass applying a single marking material, one-pass full-color marking material, applying a material not visible to the unaided eye, applying a pre-marking treatment material, a post-marking treatment material, etc., with the ability to tailor the position of the marking material in or at the ports to address considerations of material quantity and quality control, charge requirements, etc. However, it should also be appreciated that the description herein is merely illustrative, and should not be read to limit the scope of the invention nor the claims hereof.

What is claimed is:

1. A structure for use in an apparatus for ejecting a material, comprising;

a body having a first channel therein for receiving a propellant stream, said first channel having a marking material receiving region;

a first marking material reservoir, the first marking material reservoir including a dielectric liquid;

a first port communicatively connecting said reservoir and said first channel, said first port including at least one separating structure, said at least one separating structure having a surface, said surface having a non-wetting material layer applied selectively thereover; and an exit orifice coupled to said first channel to output a marking material steam carried by the propellant stream, the marking material stream does not deviate by more than 20 percent from a width of the exit orifice for a distance of at least four times the exit orifice width.

2. The structure of claim 1, wherein said port is a generally cylindrical opening defined by a wall extending between said reservoir and said first channel, and further wherein said at least one separating structure is said wall.

3. The structure of claim 2, wherein said non-wetting material is applied to said wall substantially entirely between said reservoir and said first channel.

4. The structure of claim 2, wherein said non-wetting material is applied to said wall from said first channel to a point spaced apart from said reservoir.

5. The structure of claim 1, wherein said first channel is defined by at least one channel wall, said at least one channel wall having a non-wetting material layer applied selectively thereover.

6. The structure of claim 5, wherein said non-wetting material layer applied selectively over said surface and said channel wall are in a contiguous relationship to one another.

7. The structure of claim 5, further including an electrode formed proximate said channel wall, wherein a non-wetting material layer is applied selectively over said electrode.

8. The structure of claim 7, wherein said non-wetting material layer applied selectively over said channel wall and said electrode are in a contiguous relationship to one another.

9. The structure of claim 1, wherein:

said body has a second channel formed therein for receiving a second propellant stream, said second channel having a second channel marking material receiving region;

a second marking material reservoir;

a second port communicatively connecting said second reservoir and said second channel, said second port including at least one second separating structure, said at least one second separating structure having a surface; and said surface of said second separating structure having a non-wetting material layer applied selectively thereover.

10. The structure of claim 1 wherein the dielectric liquid is a clear carrier liquid that includes suspended particulate solids.

11. The structure of claim 10 wherein the clear carrier liquid is a clear hydrocarbon.

12. The structure of claim 10 wherein the dielectric liquid has a high viscosity.

13. A structure for use in an apparatus for ejecting a material, comprising;

a body having a first channel therein for receiving a propellant stream, said first channel having a marking material receiving region;

a first marking material reservoir, the first marking material reservoir including a dielectric liquid;

a first port communicatively connecting said reservoir and said first channel, said fist channel is defined by at least one channel wall, said at least one channel wall having a non-wetting material layer applied selectively thereover; and an exit orifice to output a marking material stream carried by the propellant stream, the marking material stream does not deviate by more than 20 percent from a width of the exit orifice for a distance of a t least four times the exit orifice width.

14. The structure of claim 13, wherein:

said body has a second channel therein for receiving a second propellant stream, said second channel having a second marking material receiving region;

a second marking material reservoir;

a second port communicatively connecting said second reservoir and said second channel; and wherein said second channel is defined by at least one channel wall, said at least one channel wall having a non-wetting material layer applied selectively thereover.

15. The structure of claim 13, wherein said port is defined by a port wall, and further wherein said first port intersects said channel wall to define a communication region, and still further wherein said non-wetting material layer is applied over said channel wall up to but not including in said communication region nor over said port wall.

16. The structure of claim 15, further including an electrode formed proximate said channel wall, wherein a non-wetting material layer is applied selectively over said electrode.

17. The structure of claim 16, wherein said non-wetting material layer applied selectively over said channel wall and said electrode are in a contiguous relationship to one another.

18. A structure for use in an apparatus for ejecting a material, comprising;

a body having a first channel therein for receiving a propellant stream, said first channel having a marking material receiving region;

a first marking material reservoir;

a first port communicatively connecting said reservoir and said first channel, said first port including at least one separating structure, said at least one separating structure having a surface, said surface having a non-wetting material layer applied selectively thereover; and an exit orifice to output a marking material stream carried by the propellant stream, the marking material stream does not deviate by more than 20 percent from a width of the exit orifice for a distance of at least four times the exit orifice width.

* * * * *